US005791891A

United States Patent [19]

Haumann

[11] Patent Number: 5,791,891

[45] Date of Patent: Aug. 11, 1998

[54] METHOD AND DEVICE FOR BURNING FUELS

[75] Inventor: Jürgen Haumann, Rekingen, Switzerland

[73] Assignee: ABB Research Ltd., Zurich, Switzerland

[21] Appl. No.: 720,435

[22] Filed: Sep. 30, 1996

[30] Foreign Application Priority Data

Sep. 30, 1995 [DE] Germany ..... 195 36 672.7

[51] Int. Cl.[6] ..... F23D 14/70; F23D 14/84

[52] U.S. Cl. ..... 431/9; 431/8; 431/181; 431/187

[58] Field of Search ..... 431/9, 181, 182, 431/187, 8, 350, 353; 60/749

[56] References Cited

U.S. PATENT DOCUMENTS

| | | | |
|---|---|---|---|
| 1,912,730 | 6/1933 | Schrader | 431/181 |
| 2,520,388 | 8/1950 | Earl . | |
| 2,823,519 | 2/1958 | Spalding . | |
| 5,498,155 | 3/1996 | Chyou et al. | 431/182 |
| 5,554,022 | 9/1996 | Nabors, Jr. et al. | 431/8 |

FOREIGN PATENT DOCUMENTS

| | | |
|---|---|---|
| 0321809B1 | 5/1991 | European Pat. Off. . |
| 0623786A1 | 11/1994 | European Pat. Off. . |
| 9003781 U | 7/1990 | Germany . |
| 4408136A1 | 9/1995 | Germany . |
| WO92/06328 | 4/1992 | WIPO . |

*Primary Examiner*—Carl D. Price
*Attorney, Agent, or Firm*—Burns, Doane, Swecker & Mathis, L.L.P.

[57] ABSTRACT

In a method and a device for burning fuels in a combustion air main stream, the combustion air is passed in a channel over at least one deltoid body. The deltoid body consists of at least one essentially triangular vortex generator area and a downstream, trapezoid flame stabilizer area. In the region of the vortex generator area, fuel is introduced into the turbulent combustion air. The vortex generator area is set via a half sweep angle and an angle of attack relative to the main stream in such a way that the spin of the longitudinal vortexes induced in the main stream is smaller than the critical spin for generating a recirculation zone. The flame stabilization area is set via a half sweep angle and an angle of attack relative to the stream in such a way that the spin of the longitudinal vortexes induced in the stream is greater than the critical spin, so that for each deltoid body, a pair of concave recirculation zones is generated, and the ignited combustion air-fuel mixture is stabilized.

9 Claims, 3 Drawing Sheets

METHOD AND DEVICE FOR BURNING FUELS

FIELD OF THE INVENTION

The invention relates to a method and a device for burning fuels in a combustion air main stream.

BACKGROUND OF THE INVENTION

Such methods and devices are known, for example, from U.S. Pat. No. 4,932,861 to Keller et al. The premix burner that is designed as a vortex burner consisting of essentially two conical half shells causes the air to rotate. The fuel is blown into the rotating air and is mixed there with it. A defined concave recirculation zone, at the tip of which the ignition takes place, is generated at the burner outlet. The flame itself is stabilized by the recirculation zone before the burner without requiring mechanical flame retention. The thermoacoustic behavior of such burners is stable, and they are characterized by a simple and cost-efficient construction.

But a few disadvantages may arise, especially when liquid fuels are used. The liquid fuel is injected into the combustion chamber with a nozzle usually provided in the tip of the premix burner. Prior to the ignition of the atomized fuel, a good mixing of combustion air and fuel is hard to achieve, since the fuel does not come into contact with all of the combustion air. If liquid fuels are used, this may result in relatively high exhaust emissions, nitrogen oxide emissions in particular. Additionally, premature ignitions may occur near the fuel nozzle or on the conical half shells. In the case of a rich operation, the burner also exhibits insufficient thermoacoustic behavior.

SUMMARY OF THE INVENTION

The object of this invention is to improve the combustion and reduce the exhaust emission in a method and a device for burning fuels in a combustion air main stream of the initially mentioned type.

According to the invention, this is accomplished in that the combustion air is passed in a channel over at least one deltoid body, whereby the deltoid body consists of at least one essentially triangular vortex generator area and a down-stream trapezoid flame stabilization area; that, in the region of the vortex generator area, fuel is introduced into the turbulent combustion air; that the vortex generator area is set via a half sweep angle and an angle of attack relative to the main stream in such a way that the spin of the longitudinal vortexes induced in the main stream is smaller than the critical spin for generating a recirculation zone; that the flame stabilization area is set via a half sweep angle and an angle of attack in relation to the stream in such a way that the spin of longitudinal vortexes in the stream is greater than the critical spin for generating a recirculation zone, thus creating a pair of concave recirculation zones for each deltoid body; and that the ignited combustion air-fuel mixture is stabilized by the recirculation zones.

A device for performing the method is characterized in that several deltoid bodies consisting of at least one essentially triangular vortex generator area and an adjoining, down-stream trapezoid flame stabilization area are located in a channel.

The advantages of the invention are, among others, that the method and the device properly divide the various functions, such as premixing and flame stabilization. This makes it possible to optimize the individual functions. The deltoid body causes small-scaled vortex currents to be generated, making it possible to achieve a very compact design. The resulting short mixing and staying times that are required lead to low costs and low emissions, especially of nitrogen oxides and carbon monoxide. The construction of such a deltoid body is also very simple, which further reduces costs. In addition, the mixing of combustion air and fuel is almost perfect and may be realized with minute pressure losses. By forming a pair of counter-rotating recirculation zones for each deltoid body, the recirculation zones stabilize each other. This minimizes the danger of the flame flashing back into the burner, thereby damaging it.

It may be particularly useful if a further trapezoid area functioning as another mixing and volatilization area is arranged between the vortex generator area and the flame stabilization area. This makes it possible to further homogenize the mixing of combustion air and fuel.

BRIEF DESCRIPTION OF THE DRAWINGS

Several preferred embodiments of the invention are shown in the accompanying drawings, in which.

DESCRIPTION OF THE INVENTION

Figure 1:
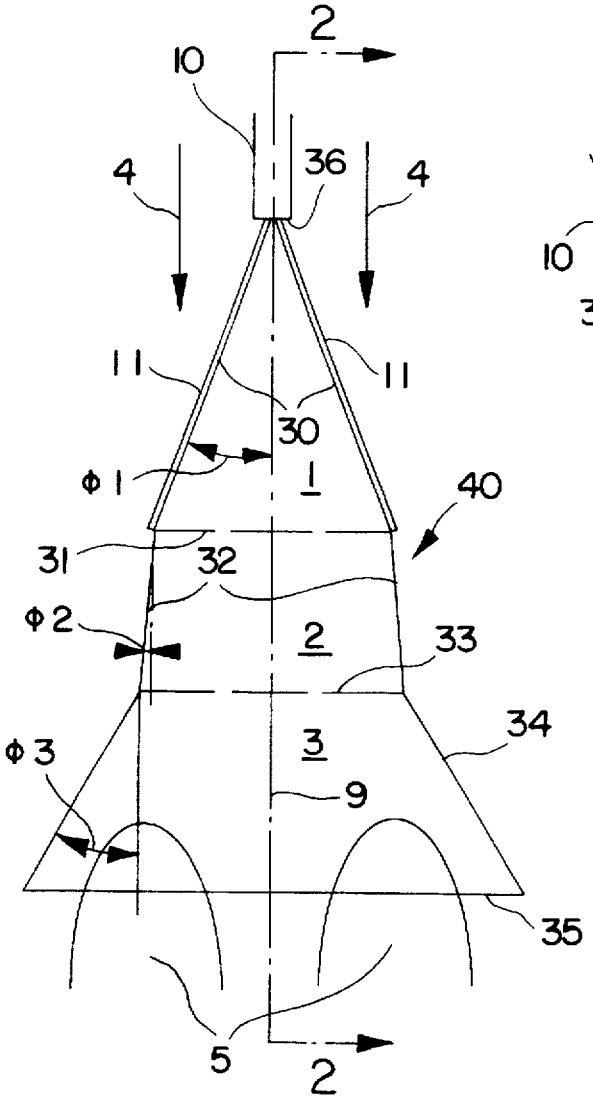
FIG. 1 shows a top view of a deltoid body in accordance with this invention.
Figure 2:
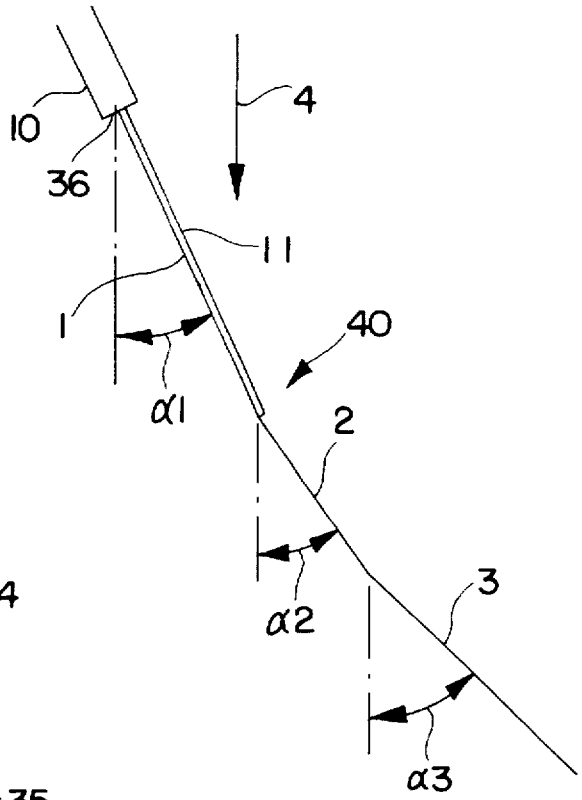
FIG. 2 shows a longitudinal section of the deltoid body along line 2—2 in FIG. 1.

FIGS. 1 and 2 show a deltoid body 40 and a fuel injection system 10, 11 of a premix burner. A channel that is arranged around the deltoid body 40 and through which a main stream 4 of combustion air, designated by the arrows, flows is not shown. The deltoid body 40 consists of three deltoid blade surface areas 1, 2 and 3 and is symmetrical to a symmetry axis 9. Because of the temperatures that occur, the deltoid body 40 is constructed of a heat-resisting material, e.g. of heat-resisting sheet steel.

The first area 1 functions as a vortex generator and mixing path and is constructed as an equilateral triangle with two side edges 30 and one connecting edge 31. A tip 36 is formed by the two side edges 30. Alternatively, the tip 36 naturally can be constructed as a front edge, whereby the first area 1 would be shaped as a trapezoid. This vortex generator 1 is defined by a half sweep angle $\phi 1$ and by an angle of attack $\alpha 1$.

The second area 2 functions as an additional mixing and volatilization path. It is constructed as an equilateral trapezoid with equally long side edges 32 and connecting edges 31 and 33, and is connected via the connecting edge 31 with the area 1. The mixing path 2 is defined by a half sweep angle $\phi 2$ and an angle of attack $\alpha 2$.

The function of the third area 3 is flame stabilization. It is also constructed as an equilateral trapezoid with equally long side edges 34, the connecting edge 33, and an edge 35, and is connected via the connecting edge 33 to the area 2. The area 3 is defined by a half sweep angle $\phi 3$ and an angle of attack $\alpha 3$.

Naturally, the transitions between areas 1, 2 and 3 at connecting edges 31 and 33 can be constructed continuously or discontinuously. It is essential, however, that the properties of the areas are set via the sweep angle $\phi i$ and an angle of attack $\alpha I$.

Analogous to U.S. Pat. No. 4,932,861 to Keller et al., it is now possible to place a fuel nozzle 10 for injecting liquid or gaseous fuels at the tip 36 formed by the side edges 30 of the area 1. In order to inject gaseous fuel, a fuel line 11 with several injection apertures (not shown) is preferably placed along the side edges 30. This fuel line naturally can extend over side edges 32, if a second area 2 is used to inject gaseous fuel.

The geometry of the area 1 of the deltoid body 40 causes the main stream 4 to be transformed into a pair of counter-rotating longitudinal vortexes when flowing around the side edges 30 of the vortex generator 1. The vortex axes of these longitudinal vortexes are located in the axis of the main stream. The spin value of the longitudinal vortexes is set via the sweep angle $\phi 1$ and the angle of attack $\alpha l$ in such a way that no vortex break-down and thus no concave recirculation zone 5 occurs. The spin of the longitudinal vortexes thus must be smaller than the critical spin at which a vortex break-down occurs. With increasing angles $\phi 1$ and $\alpha 1$, the vortex intensity or spin value can be increased, up to the range of a vortex break-down. The spin of the longitudinal vortexes is used to adjust the path necessary for mixing the main stream and fuel stream.

The area 2 is optional and is only used if the mixing path formed by area 1 is insufficient for a homogeneous mixing. In this case also, longitudinal vortexes are induced in the stream by the side edges 32. The spin value of the longitudinal vortexes is set via the sweep angle $\phi 2$ and the angle of attack $\alpha 2$ corresponding to area 1 in such a way that no vortex break-down and thus no recirculation zone 5 occurs.

Naturally, it is possible for additional areas that correspond to area 2 to follow area 2 downstream in order to achieve a homogeneous mixture.

The function of area 3 is flame stabilization by means of the longitudinal vortexes generated by the side edges 34. The spin value of the longitudinal vortexes is set by the sweep angle $\phi 3$ and angle of attack $\alpha 3$ in such a way that vortex break-down occurs. A pair of recirculation zones 5 is created for each deltoid body 40. The spin of the longitudinal vortexes must be greater than the critical spin at which a vortex break-down occurs. The gradient in the spin value of the upstream area 1 or 2 to area 3 is selected very high in order to achieve a thermoacoustically stable behavior. In order to support the flame stabilization, the cross-section of the channel (not shown) can be additionally enlarged. The deltoid body 40 has a thermoacoustically stable behavior, even during rich operation.

Figure 3:
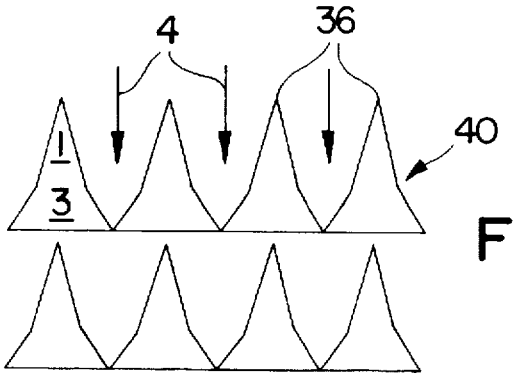
FIG. 3 shows an arrangement of the deltoid bodies by rows.

According to FIG. 3, the deltoid bodies 40 can be arranged in rows. The deltoid bodies are hereby arranged in large numbers in parallel rows or concentric rings, e.g. near an annular combustion chamber. Normally, not every tip 36 of the deltoid body 40 is provided with a fuel nozzle 10.

Figure 4:
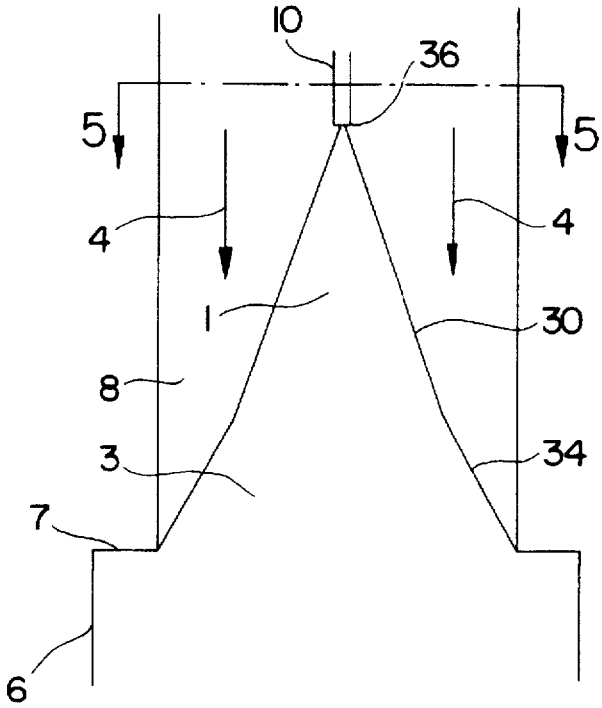
FIG. 4 shows a partial longitudinal section taken along line 4—4 in FIG. 5 through a channel with deltoid bodies arranged in them.
Figure 5:
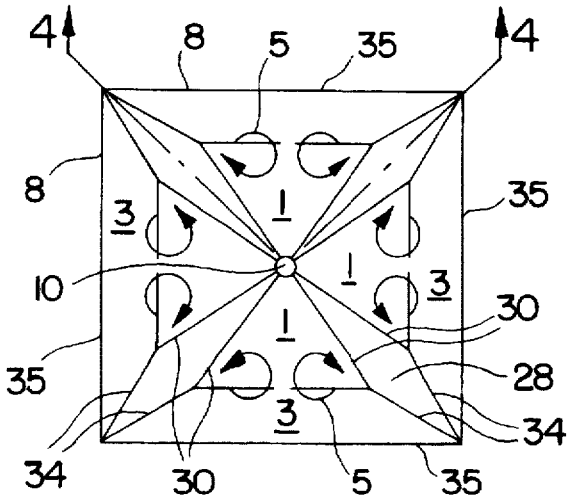
FIG. 5 shows a partial cross-section through the channel along line 5—5 in FIG. 4.

In FIG. 4 and FIG. 5, four deltoid bodies are located in a rectangular channel 8 in such a way that the tips 36 come to rest in the center of the channel 8 upstream. The four deltoid bodies 40 are connected via their tips 36 with each other, and via their edges 35 with the channel 8. As may be seen in FIG. 5, the sweep angles $\phi 1$, $\phi 3$ and the angles of attack $\alpha 1$, $\alpha 3$ of the deltoid bodies 1, 3 position the deltoid bodies so that flow passages 28 are formed between the edges of adjacent deltoid bodies. A fuel nozzle 10 is provided at the tip 36 of the deltoid bodies 40. The fuel is blown into the longitudinal vortexes created in the combustion air 4 when it flows around the edges 30, 34, and is mixed there with the combustion air. Due to an adequate intermixing by area 1, the area 2 is eliminated here. At the burner outlet 7, as a result of area 3 of the deltoid body 40 and an increase of the cross-section at the burner outlet 7 resulting in the combustion chamber 6, eight concave recirculation zones are created, at the tip of which the ignition take takes place. The flame itself is stabilized by the recirculation zones 5 without requiring a mechanical flame retention. Naturally, the channel 8 can also be circular in construction, and the number of deltoid bodies 40 per channel 8 is optional and must be adapted to the respective conditions.

Figure 6:
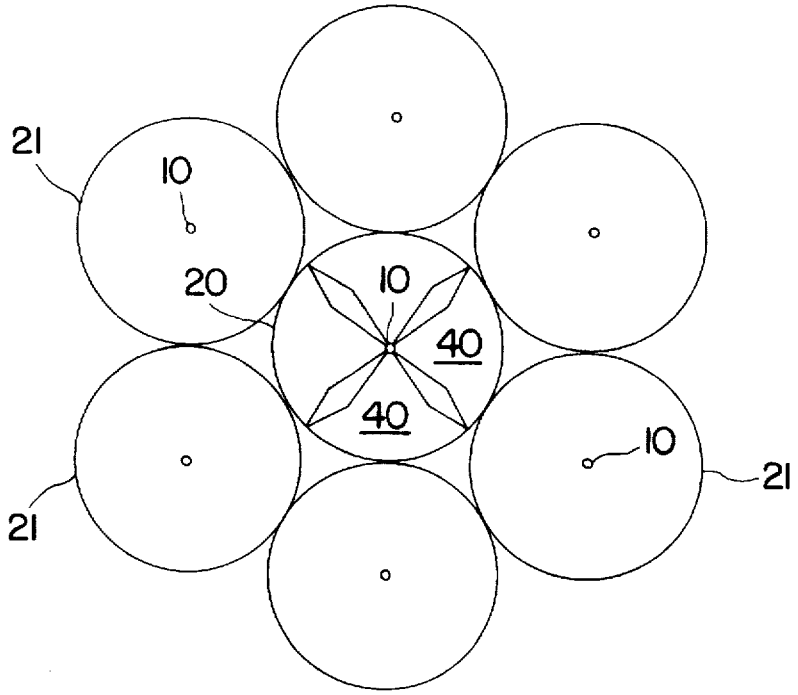
FIG. 6 shows a top view of a pipe burner with deltoid bodies.

In FIG. 6, the deltoid bodies 40 are arranged in a round channel 20. They are arranged in a manner similar to FIG. 4 and FIG. 5. For this purpose, the deltoid bodies 40 must be curved in construction. Mixing pipes 21 are arranged without flame stabilization around the circular channel 20. Combustion air is blown through the mixing pipes 21 and fuel is nozzled through nozzles 10 into the combustion air. For better intermixture, generally known mixing elements, such as deflectors with a blade profile, can be arranged in the mixing pipes 21. Such a burner arrangement is suitable for unstepped (lean-lean) and stepped (rich-lean) operation. The number of mixing pipes 21 arranged around channel 20 is optional and must be adapted to the respective conditions.

Figure 7:
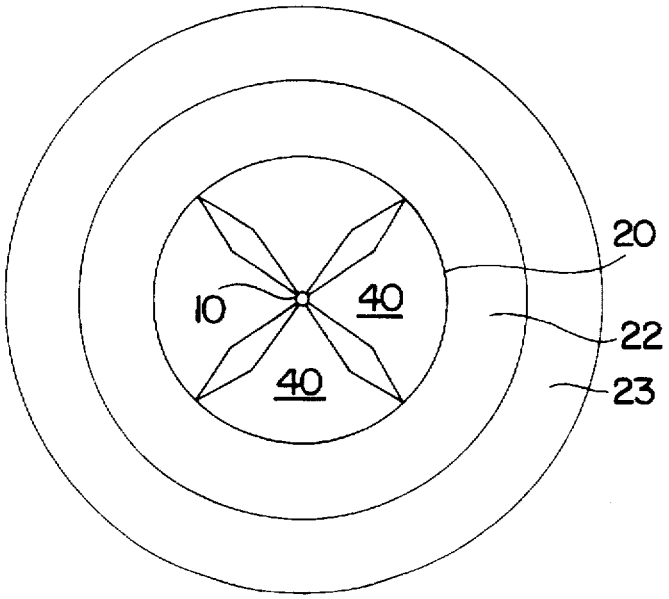
FIG. 7 shows a top view of a core burner with deltoid bodies and layered combustion.

In FIG. 7, a circular, deltoid body is arranged in a burner system according to WO 92/06328. This document describes a burner with a very low nitrogen oxide emission. In the center of the burner system described there, there is a fuel-rich flame zone surrounded by one or more zones with low fuel content. The flame is radially layered for this purpose, creating a large, radial density gradient in the flame. The fuel-rich zone contains less than the stoichiometric content of oxygen. Due to the radial layering, the fuel-rich flame core is protected from intermixing with the remaining combustion air. The recirculation of combustion gases into the outer, fuel-poor layers makes it possible to further reduce the nitrogen oxide emission. The recirculated combustion gas reduced the oxygen content and flame temperature.

A circular channel 20 with deltoid bodies 40 arranged in it is surrounded by two concentric, annular channels 22 and 23. A fuel nozzle 10 is arranged at the tip 36 of the deltoid bodies. The delta-premix burner 40 is now operated hypostoichiometrically, i.e. in a fuel-rich manner. An exhaust/air mixture, possible with a spin, is supplied axially via the concentric channels 22, 23. The number of concentric channels 22, 23 surrounding the channel 20 is optional and must be adapted to the respective conditions.

The invention is naturally not limited to the illustrated and described exemplary embodiments. The deltoid bodies can also be attached differently in the channel, e.g. in such a way that the downstream edge of the third area forms a slot with the channel and the tips do not contact each other. The delta-premix burner can also be integrated in optional other burner configurations.

What is claimed is:

1. Method for burning fuels in a combustion air main stream, comprising:

passing combustion air in a channel in a main flow direction over at least one deltoid body, the deltoid body having at least one triangular shaped vortex generator part and a down-stream trapezoid shaped flame stabilization part;

introducing fuel in the channel at a region including the vortex generator part to mix in the combustion air, the vortex generator part having side edges with a half sweep angle and being oriented at an angle of attack relative to the main flow direction selected so that longitudinal vortexes are induced in the main flow having a spin smaller than a critical spin for generating a recirculation zone;

allowing the fuel and combustion air to flow over the flame stabilization part, igniting the fuel and combustion air in a combustion space downstream of the flame stabilization part, wherein, the flame stabilization part has side edges at a half sweep angle and is oriented at an angle of attack in relation to the main flow direction selected so that longitudinal vortexes are generated in the flow to have a spin greater than the critical spin for generating a recirculation zone, wherein a pair of concave recirculation zones are generated for each deltoid body at a downstream end of the flame stabilization part, and wherein a flame of the ignited combustion air-fuel mixture in the downstream combustion space is stabilized by the recirculation zones.

2. Method as claimed in claim 1, further comprising allowing the fuel and combustion air to flow past at least one additional trapezoid shaped part disposed between the vortex generator part and the flame stabilization part, wherein additional mixing and volatilization of the fuel occurs and wherein the at least one additional trapezoid shaped part has sides at a half sweep angle and is oriented at an angle of attack relative to the main stream selected so that longitudinal vortexes are induced in the flow having a spin smaller than the critical spin.

3. A device for mixing and burning fuels in a combustion air main stream, comprising:

a channel for guiding a combustion air flow in a main flow direction;

a plurality of deltoid bodies, each deltoid body having at least one triangular shaped vortex generator part and a downstream trapezoid shaped flame stabilization part; and means for introducing fuel in the channel near the at least one triangular shaped vortex generator part;

wherein the vortex generator part has side edges at a half sweep angle and being oriented at an angle of attack relative to the main flow direction selected to generate longitudinal vortexes in the flow to have a spin smaller than a critical spin for generating a recirculation zone, and wherein, the flame stabilization part has side edges at a half sweep angle and is oriented at an angle of attack in relation to the main flow direction selected to generate longitudinal vortexes in the flow to have a spin greater than the critical spin for generating a recirculation zone at a downstream end of the flame stabilization part.

4. Device as claimed in claim 3, wherein each deltoid body further comprises at least one additional trapezoid shaped part located between the vortex generator part and the flame stabilization part.

5. Device as claimed in claim 3, wherein said means for introducing a fuel includes a fuel nozzle located on at least one tip formed by the side edges of the vortex generator.

6. Device as claimed in claim 3, wherein said means for introducing fuel includes fuel injection lines located on the side edges of the vortex generator part.

7. Device as claimed in claim 3, wherein said plurality of deltoid bodies are connected with each other at tips formed by the side edges of the respective vortex generator parts, and wherein each of said plurality of deltoid bodies is connected at a downstream edge of the flame stabilization part to a wall of the channel.

8. Device as claimed in claim 3, further comprising a plurality of combustion air and fuel mixing pipes disposed around the channel.

9. Device as claimed in claim 3, further comprising at least one concentric channel arranged around the channel.

* * * * *